US005725236A

United States Patent [19]

Stephanova et al.

[11] Patent Number: 5,725,236

[45] Date of Patent: Mar. 10, 1998

[54] SKI WITH IMPROVED PROFILE

[75] Inventors: Milena Stephanova, Seyssinet Pariset; Jacques Perenon, Voiron, both of France

[73] Assignee: Skis Rossignol SA, France

[21] Appl. No.: 252,440

[22] Filed: Jun. 1, 1994

[30] Foreign Application Priority Data

Jun. 2, 1993 [FR] France ..... 93 06807

[51] Int. Cl.[6] ..... A63C 5/04

[52] U.S. Cl. ..... 280/609; 280/601; 280/602

[58] Field of Search ..... 280/601, 602, 280/608, 609, 610, 607

[56] References Cited

U.S. PATENT DOCUMENTS

| | | | |
|---|---|---|---|
| 1,998,702 | 4/1935 | Boline | 280/609 |
| 4,219,206 | 8/1980 | Kjesbo | 280/601 |
| 4,697,821 | 10/1987 | Hayashi et al. | 280/609 |
| 4,778,197 | 10/1988 | Floreani | 280/602 |
| 4,957,304 | 9/1990 | Diard et al. | 280/609 |
| 5,002,300 | 3/1991 | Pascal et al. | 280/610 |
| 5,335,931 | 8/1994 | Lacroix et al. | 280/602 |
| 5,366,234 | 11/1994 | Rohrmoser | 280/607 |
| 5,427,401 | 6/1995 | Liard | 280/602 |

FOREIGN PATENT DOCUMENTS

| | | | |
|---|---|---|---|
| 446936 | 3/1948 | Canada | 280/609 |
| 717397 | 9/1965 | Canada | 280/609 |
| 0283331 | 9/1988 | European Pat. Off. . | |
| 0465794 | 1/1992 | European Pat. Off. . | |
| 0470347 | 2/1992 | European Pat. Off. | 280/609 |
| 1339600 | 9/1963 | France | 280/609 |
| 2522976 | 9/1983 | France . | |
| 2523460 | 9/1983 | France . | |
| 2639836 | 6/1990 | France . | |
| 2699827 | 7/1994 | France | 280/610 |
| 44-15097 | 7/1969 | Japan | 280/607 |

*Primary Examiner*—Brian L. Johnson
*Assistant Examiner*—Min Yu
*Attorney, Agent, or Firm*—Wall Marjama & Bilinski

[57] ABSTRACT

A ski having a tip region, a heel region, and a central zone, is provided with a running sole having longitudinal sides and a longitudinal axis, an edge formed on each of the sides of the running sole, and an upper face including at least two side faces being non-parallel to the running sole. The at least two side faces intersect each other above the running sole to create a ridge extending longitudinally over at least part of the ski. The ridge is asymmetrical with respect to a longitudinal mid-plane through the longitudinal axis of the running sole.

17 Claims, 3 Drawing Sheets

2
4
5
1
6
7
8
3

4
6
5
8
18

6
25
8
14
10
6
8
24
18

5
8
6
18

SKI WITH IMPROVED PROFILE

BACKGROUND OF THE INVENTION

1. Field of the Invention

The invention relates to a ski with a special profile, more particularly intended for the practice of alpine skiing, comprising a central region called a "central zone", on which the bindings for the skier are positioned, and two end regions, one called the tip and the other called the heel.

2. Discussion of the Related Art

Traditionally, most skis currently available are symmetrical with respect to their longitudinal mid-plane, so that the right ski is entirely interchangeable with the left ski. In fact, it has generally been considered hitherto that this lack of differentiation of one ski with respect to the other was of no consequence or of very little consequence as regards actual skiing.

Now, the advantage of having asymmetric skis, namely a right ski and a left ski, has been realized, in particular as regards the level of efficiency of setting the edges and thereby the response of these skis.

It has already been known for a long time that this edge setting is particularly efficient at the inner edge of each ski. It is therefore important to have available a ski through which the action of the skier is amplified on the inner side, this amplification being obtainable, for example, by increasing the density of the ski at this location, or its thickness, in order to increase the efficiency of the pressures applied by the skier.

In parallel, it is undoubtedly important to be able to optimize the action of the inner edge of the ski more particularly at the central zone, and it is also expedient to be able to "cut" into the snow at the outer ends of the ski, that is to say close to the tip and the heel, in view of the fact that, during turning, the ends of the ski side-slip and that, in particular, this side-slipping also occurs with a slight pivotal movement with respect to the central zone, so that the said ends are in a relative rotational movement with respect to the said central zone and must therefore be able to move almost freely whatever the condition of the snow, whence this requirement of giving them this ability to penetrate, which is obtained only with thin ends, more particularly at the front and rear contact lines respectively.

Now, these various requirements have never been combined simultaneously within one and the same ski, in view of the apparently conflicting results which they seem to generate. In addition, other constraints, such as the flat positioning of the bindings, the height of the foot of the skier on the ski and the weight of the skier, have prevented the development of its shape.

In order to give the ski some degree of rigidity in simple bending, that is to say perpendicularly to the plane defined by the surface of the sole, they have been fitted with a longitudinal rib, which is strictly linear, positioned along the mid-line of the ski. This rib is continuous (see U.S. Pat. No. 2,158,325) or discontinuous (FR-A-2,523,460), which, in view of its position, gives the ski thus produced no asymmetry.

Asymmetric skis have also been proposed in document DE-A-1,939,540, in which the top located on the inner side of each of the skis of one and the same pair is parallel to the surface of the running sole, while the outer side, except optionally at the central zone, is inclined. Although admittedly it is thereby possible to obtain the effect of cutting into the snow at the outer edge, this type of ski nevertheless does not improve the efficiency of setting the inner edge.

OBJECTS AND SUMMARY OF THE INVENTION

The object of the invention is to provide an asymmetric ski, the special profile of which makes it possible to satisfy the new requirement of users, whilst retaining its behavior characteristics.

This ski, in particular an alpine ski, comprises a running sole, optionally bordered by edges joined to the upper face directly or via vertical or inclined sidewalls.

It is characterized in that its upper face has a relief profile defining, in cross section, at least two side faces not parallel to the surface of the sole, the intersection of which defines at least one imaginary ridge extending lengthwise over at least part of the ski and asymmetrically with respect to the longitudinal mid-plane of the sole of said ski.

In other words, the invention consists in providing a ski whose upper face is not planar but forms, over at least most of it, two inclined side faces, the line of which constituted by the culminant points constitutes a curve located asymmetrically with respect to the longitudinal mid-plane of the ski, defined as being the plane perpendicular to the base of the running sole and passing through the mid-axis of symmetry thereof.

The projection of this curve, consisting of the culminant points, and called the "crest line", onto the plane defined by the surface of the sole may be straight or of winding shape. The curve may be continuous from one of the ends of the ski to the other, or located on one or more portions thereof.

This special profile thus defines, over all or part of the length of the ski, two slopes, the inclination of which, with respect to the surface of the sole, on the one hand, and the relative dimension of one with respect to the other, vary or remain constant all along the ski.

It is thus possible by this means to enhance the quantity, the density of material or the position of the internal components at well-specified places, so as to optimize the action of the skier on the snow.

According to one particular embodiment of the invention, the projection of the upper ridge or crest line onto a plane perpendicular to the base of the sole and directed parallel to the mid-axis of symmetry thereof has no point of inflexion, the profile of the said ridge being substantially curved, the uppermost point being located in the region of the central zone.

In practice, the ridge is imaginary, and does not have a true corner but rather a curved portion, because it is preferably produced by folding. The radius of this curvature is at most equal to 10 (ten) millimeters.

According to the invention, the two slopes located on either side of the ridge are either both concave or convex or alternatively one is concave and the other is convex.

According to another embodiment of the invention, the ski comprises two or more ridges on one or more portions in question, each of the side faces whose intersection defines the ridges always being inclined with respect to the base of the sole.

According to another embodiment of the invention, the ridge or ridges are interrupted in order to define, at the level of the central zone, a planar region parallel to the base of the sole.

According to other embodiments of the invention, the projection of the upper ridge into a plane perpendicular to the base of the sole and directed parallel to the axis of symmetry thereof has at least one or even more than one point of inflexion thereby defining a central raised platform or a central recess at the level of the central zone.

According to one advantageous characteristic of the invention, the projection of the ridge onto the plane defined by the base of the sole is substantially tangent to the lower border of the right or left ski in question at the level of the central zone.

Finally, according to another characteristic of the invention, the side faces extending on either side of the ridge are made from different kinds of material. In this way, and in view of their mechanical properties which are themselves different, this differentiation of the side faces generates a behavior which is different between each of the sides of the ski, in particular in setting the edges.

According to the invention, the region of positioning of the constituent elements of the bindings has a surface consisting of at least two side faces which are inclined with respect to the surface of the sole.

The skis thus defined are asymmetric. In parallel, the two skis constituting one and the same pair are optical isomers of one another, that is to say that they are symmetrical with one another with respect to a vertical plane separating the two skis and which is situated at one and the same distance from said skis. The skis of one and the same pair are therefore stereoisomers.

BRIEF DESCRIPTION OF THE DRAWING

The manner in which the invention may be embodied and the advantages which result therefrom will emerge better from the embodiments which follow, given by way of indication and without limitation, in support of the attached figures wherein.

DETAILED DESCRIPTION OF THE PREFERRED EMBODIMENTS

Figures 1, 2, 3, 4:
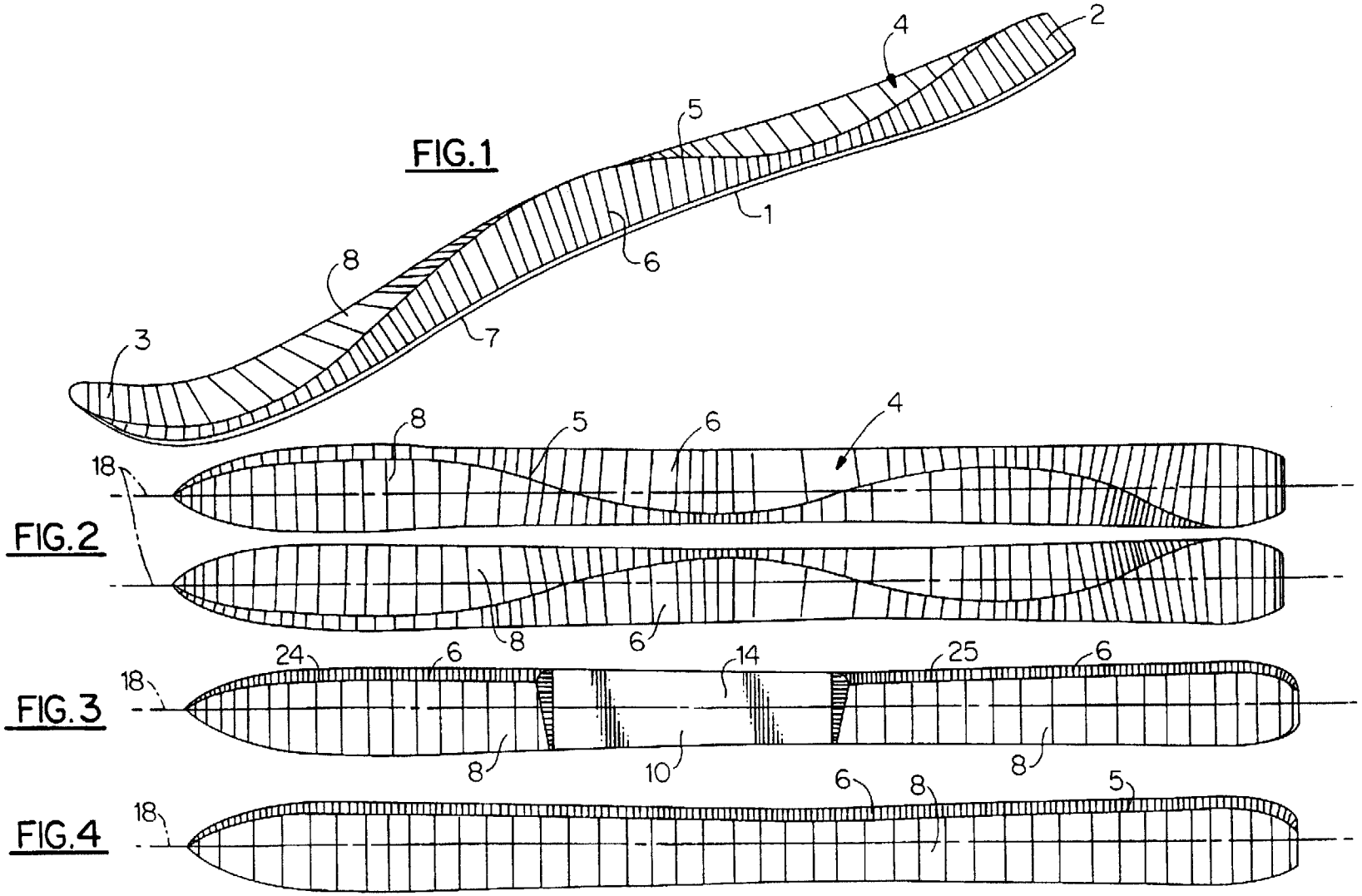
FIG. 1 is a schematic representation in perspective of a left ski according to the invention.
FIG. 2 represents a pair of skis according to the invention in plan view.
FIGS. 3 and 4 are also, seen from above, other embodiments of a left ski according to the invention.
Figure 5:
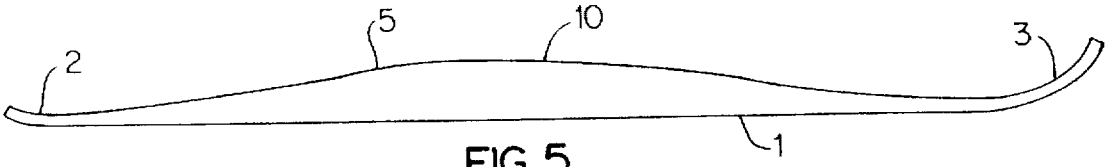
FIGS. 5, 6 and 7 are three profile views of the ski, showing the outline of the crest line or ridge according to the invention.

The ski defined hereinbelow is an alpine ski, and has, in the traditional manner, a running sole (1), extending between its two ends, respectively the rear (2) end (heel) and front (3) end (the tip). This ski may have a shell or, on the other hand, be more traditional. In addition, it may be provided with visible sidewalls (7) or, in the case of a shell ski, may not have sidewalls.

The sole (1) has a longitudinal mid-axis (18) or axis of symmetry.

The ski has an upper face (4) which, throughout the description, should be understood to be the surface extending from the upper end of one lateral sidewall (7) to the other when they exist, or directly from one metal edge (20) to the other (21), in the case of a shell ski.

Figure 8:
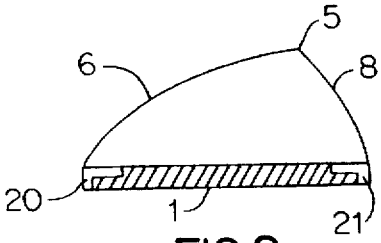
FIGS. 8, 9, 10 and 11 are four cross sections of a ski according to four different embodiments.
Figure 9:
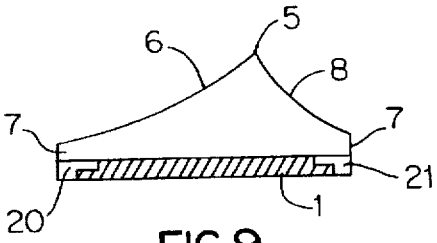
Figure 10:
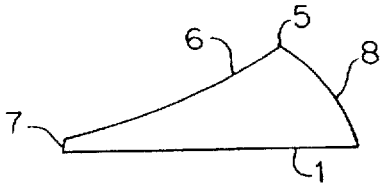

According to the invention, the upper surface (4) is in relief and has at least one upper ridge (5) corresponding to the highest point of the ski in the cross section passing through this point. This ridge is of winding shape, extending substantially over the entire length of the ski in the embodiment described in conjunction with FIGS. 1 and 2. In fact, this upper ridge (5) defines two slopes, respectively (6) and (8), which are inclined with respect to the plane of the base of the sole, of convex (FIG. 8), concave (FIG. 9) shape or both (FIG. 10). These slopes in fact extend from the upper end of the lateral sidewalls (7) when they exist (FIG. 9), or from the upper part of the edges (20, 21) to the ridge (5) proper (FIG. 8).

This ridge (5) never coincides with the plane perpendicular to the base of the sole (1) and passing through the longitudinal axis of symmetry (18).

In addition, this ridge has, in projection onto a plane perpendicular to the base of the sole and directed along the longitudinal axis (18), a curved profile, the culminant point of which profile is located in the vicinity of the central zone. This culminant point, measured in the thickest section of the ski is advantageously offset with respect to the mid-line (18) of the ski. In fact, at least one local increase in the thickness of one or other of the sides of the ski is generated, in particular at the level of the central zone, thus achieving differentiation of one ski from the other, and in particular the definition of a right ski and a left ski. This ridge is continuous in the embodiment described in FIGS. 1, 2, 4 and 5.

Figure 6:
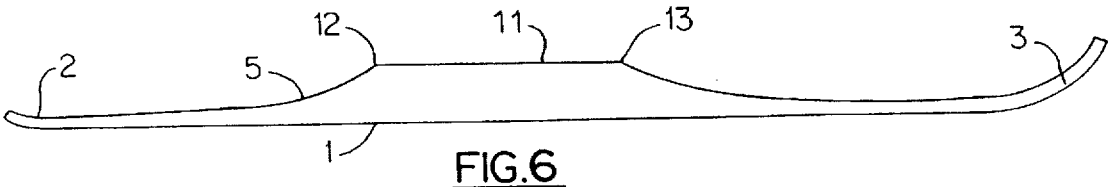
Figure 7:
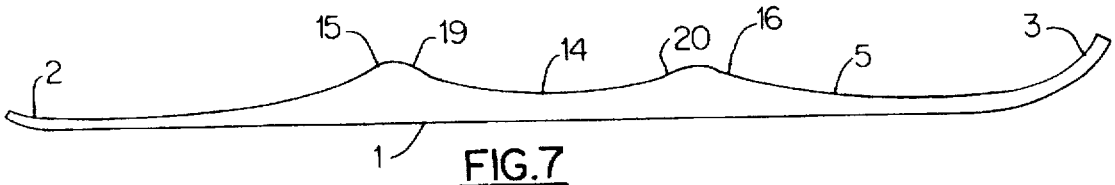

In another embodiment, described in particular in conjunction with FIG. 3, the ridge (5) is replaced by two ridges (24) and (25) forming a discontinuity, in particular at the level of the central zone. The ridges (24, 25) are, in this figurative case, straight and in the extension of one another, but they might form substantially two nonlinear curves converging toward the central zone (10). This region (10) in this case is planar, the ski seen in profile then having the shape represented in FIGS. 6 and 7. The presence of points of inflexion on the ridge (5) is further observed in these FIGS. 6 and 7: two (12, 13) in FIG. 6 and four (15, 16, 19, 24) in FIG. 7. In this way, a central raised platform (11) can be defined, or alternatively a recess (14) which is also central, capable of receiving the bindings.

Figure 11:
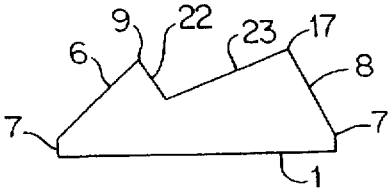

FIG. 11 shows a variant of the invention in which, over a specific portion of the ski, the upper face comprises two ridges (9, 17), which may or may not be parallel and may or may not have the same "altitude", and actually defining four side faces (6, 8, 22, 23) not parallel to the base of the running sole (1).

In view of the fact that these edges (5, 9, 17) project with respect to the lower plane of the ski, they are subjected to numerous impacts during skiing. It is possible to protect the ridge or ridges, on the outside by adding on an additional protective element, or alternatively on the inside at the level of the internal structure of the ski.

Figure 12:
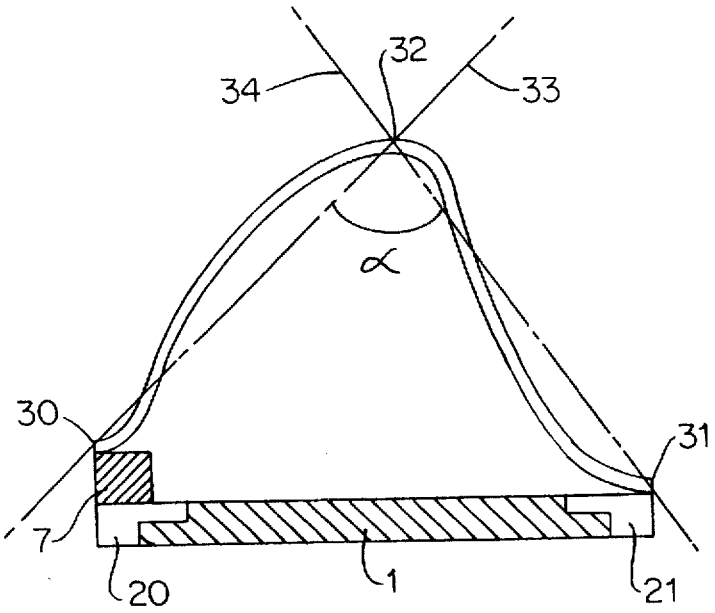
FIG. 12 is a cross section of a ski defining the apex angle of the ridge.

Referring to FIG. 12, the following definitions are made:

by the reference (30), the upper outer ridge of the sidewall (7) when it exists;

by the reference (31), the upper outer ridge of the metal edge in the absence of a sidewall;

by the reference (32), the culminant point of the ridge (5) in a specific cross section;

by the reference (33), the imaginary straight line joining (30) to (32) when there is a sidewall (7);

by the reference (34), the imaginary straight line joining (31) to (32) in the absence of a sidewall.

The angle $\alpha$ is defined as being the value of the angle between the straight lines (33) and (34), as drawn in FIG. 12.

According to one characteristic of the invention, the angle α at the apex of the ridge (5) and defined in the above manner may be constant or variable over the entire length of the ski, this being a function of the degree of asymmetry desired or of the position and of the height desired for the ridge.

In another variant of the invention, the two side faces located on either side of the ridge (5) and constituting the top of the ski are made of different materials, for example from ABS or from polyurethane, polyethylene, a glass laminate or an aluminum-based alloy, so as to give the two sides of the ski different mechanical characteristics.

The special shape of the ski thus obtained allows advantageous distribution of the masses, both in the longitudinal plane and in the transverse plane, this mass distribution making it possible to alter the distribution of the flexibility of the ski over its length (simple bending and side bending), its torsional strength as well as the rigidity of the support.

These asymmetric right and left skis thus have very good resilience and response characteristics, by virtue of the special profile, which optimizes the action of the skier at the level of the inner edges, in particular in the middle region of the central zone, and further, by virtue of the expedient distribution of the thicknesses.

While this invention has been described in detail with reference to certain preferred embodiments, it should be appreciated that the present invention is not limited to those precise embodiments. Rather, in view of the present disclosure which describes the best mode for practicing the invention, many modifications and variations would present themselves to those of skill in the art without departing from the scope and spirit of this invention, as defined in the following claims.

What is claimed is:

1. A ski having a tip region, a heel region, and a central zone, said ski comprising a running sole having longitudinal sides and a longitudinal axis, an edge formed on each of the sides of said running sole, and an upper face including at least two side faces being non-parallel to said running sole, said at least two side faces intersecting each other above said running sole to create a ridge, said ridge being asymmetrical with respect to a longitudinal mid-plane through said longitudinal axis of said running sole, said ridge being continuous from the heel region to the tip region, and a profile of said ridge, formed by a projection of the ridge onto a plane through said longitudinal axis and perpendicular to said running sole, is substantially curved without an inflection point so that a culminant point of said ridge is positioned proximate the central zone.

2. A ski having a tip region, a heel region, and a central zone, said ski comprising a running sole having longitudinal sides and a longitudinal axis, an edge formed on each of the sides of said running sole, and an upper face including at least two side faces being non-parallel to said running sole, said at least two side faces intersecting each other above said running sole to create a ridge extending longitudinally over at least part of the ski, said ridge being asymmetrical with respect to a longitudinal mid-plane through said longitudinal axis of said running sole, wherein a projection of said ridge onto a plane parallel to said running sole is winding in shape.

3. The ski according to claim 2 wherein the side faces are concave with respect to a plane through said longitudinal axis and perpendicular to said running sole.

4. The ski according to claim 2 wherein the side faces are convex with respect to a plane through said longitudinal axis and perpendicular to said running sole.

5. The ski according to claim 2 wherein one of the side faces is convex with respect to a second plane through said longitudinal axis and perpendicular to said running sole and the other side face is concave relative to said second plane.

6. The ski according to claim 2 wherein a cross section of said ridge includes an apex having an angle α being of a constant value along the length of said ridge.

7. The ski according to claim 2 wherein a cross section of said ridge includes an apex having an angle α being of a changing value along the length of said ridge.

8. The ski according to claim 2 wherein said ridge is continuous from the heel region to the tip region, and a profile of said ridge, formed by a projection of the ridge onto a plane through said longitudinal axis and perpendicular to said running sole, is substantially curved without an inflection point so that a culminant point of said ridge is positioned proximate the central zone.

9. The ski according to claim 2 wherein each face of said at least two side faces is made of a material selected from the group consisting of ABS (acryl-butyl styrene), polyurethanes, polyethylenes, glass laminates, and aluminum-based alloys.

10. The ski according to claim 2 wherein the central zone is inclined with respect to said running sole, and formed to receive elements of a boot binding.

11. The ski according to claim 2 including at least one side wall formed between one of said at least two side faces and a corresponding side edge.

12. The ski according to claim 11 wherein said at least one side wall is vertical with respect to said running sole.

13. The ski according to claim 11 wherein said at least one side wall is inclined with respect to said running sole.

14. A pair of skis including a right ski and a left ski, each ski of the pair having a tip region, a heel region, and a central zone, the right ski comprising:

a running sole having longitudinal sides and a longitudinal axis;

an inside edge and an outside edge, each edge formed on one of the longitudinal sides of said running sole; and, an upper face including two side faces being non-parallel to said running sole, said at least two side faces intersecting each other above said running sole to create a right ridge extending longitudinally between the heel region and the tip region of the ski and is formed tangent said inside edge of the right ski, said right ridge being asymmetrical with respect to a longitudinal mid-plane through said longitudinal axis of said running sole, said left ski comprising:

a running sole having longitudinal sides and a longitudinal axis;

an inside edge and an outside edge, each edge formed on one of the longitudinal sides of said running sole; and, an upper face including two side faces being non-parallel to said running sole, said at least two side faces intersecting each other above said running sole to create a left ridge extending longitudinally between the heel region and the tip region of the ski and is formed tangent said inside edge of the left ski, said left ridge being asymmetrical with respect to a longitudinal mid-plane through said longitudinal axis of said running sole, said right ridge and said left ridge being optical isomers of each other.

15. The pair of skis according to claim 14 wherein each face of said at least two side faces of each ski is made of a material selected from the group consisting of ABS (acryl-butyl styrene), polyurethanes, polyethylenes, glass laminates, and aluminum-based alloys.

16. The pair of skis according to claim 14 wherein the central zone of each ski is inclined with respect to its corresponding running sole, and formed to receive elements of a boot binding.

17. A pair of skis including a right ski and a left ski, each ski of the pair having a tip region, a heel region, and a central zone, the right ski comprising:

a running sole having longitudinal sides and a longitudinal axis;

an inside edge and an outside edge, each edge formed on one of the sides of said running sole; and, an upper face including at least two side faces being non-parallel to said running sole, said at least two side faces intersecting each other above said running sole to create a right ridge extending longitudinally over at least part of the ski, said right ridge being asymmetrical with respect to a longitudinal mid-plane through said longitudinal axis of said running sole, said left ski comprising:

a running sole having longitudinal sides and a longitudinal axis;

an inside edge and an outside edge, each edge formed on one of the sides of said running sole; and, an upper face including at least two side faces being non-parallel to said running sole, said at least two side faces intersecting each other above said running sole to create a left ridge extending longitudinally over at least part of the ski, said left ridge being asymmetrical with respect to a longitudinal mid-plane through said longitudinal axis of said running sole, said right ridge and said left ridge being optical isomers of each other, and wherein said left ridge of the left ski is continuous, extends between the heel region and the tip region of the ski, and is formed tangent said inside edge of the left ski, and wherein said right ridge of the right ski is continuous, extends between the heel region and the tip region of the ski, and is formed tangent said inside edge of the right ski.

* * * * *